United States Patent [19]

Ringler

[11] Patent Number: 4,836,487

[45] Date of Patent: Jun. 6, 1989

[54] CONCRETE CURB FORM HANGER

[76] Inventor: Michael Ringler, 3318 Foxfire Ct., Fairfield, Calif. 94533

[21] Appl. No.: 165,140

[22] Filed: Mar. 7, 1988

[51] Int. Cl.[4] ..... E01C 19/50; E04G 13/00

[52] U.S. Cl. ..... 248/303; 248/249; 248/218.4; 249/8; 249/216; 249/219.1

[58] Field of Search ..... 248/302, 303, 218.1–218.3, 248/249, 48.1, 48.2; 249/3, 4, 5, 8, 216, 219.1

[56] References Cited

U.S. PATENT DOCUMENTS

| | | | |
|---|---|---|---|
| 319,466 | 6/1885 | Dippry | 248/48.1 |
| 1,020,791 | 3/1912 | Baldwin | 248/303 |
| 1,308,066 | 7/1919 | Hayes | 248/301 X |
| 1,728,613 | 9/1929 | Jones | 248/302 |
| 3,151,831 | 10/1964 | O'Meara | 248/218.2 |
| 3,802,572 | 4/1974 | Shackel | 248/302.4 |

FOREIGN PATENT DOCUMENTS

| | | | |
|---|---|---|---|
| 1114701 | 5/1968 | United Kingdom | 248/221.2 |

*Primary Examiner*—Alvin C. Chin-Shue
*Attorney, Agent, or Firm*—William S. Bernheim

[57] ABSTRACT

A hanger for constructing concrete curb forms and form from a continuous metal rod bent so that the hanger can be attached to a backboard and faceboard and secured to a backboard stake to position and support the faceboard.

5 Claims, 1 Drawing Sheet

CONCRETE CURB FORM HANGER

BACKGROUND OF THE INVENTION

1. Field of the Invention

The present invention relates to a metal hanger for fixing elevation and supporting a face board when constructing curb forms for concrete pours.

2. Description of the Prior Art

Concrete is a widely used building material. Concrete begins as a fluid mixture which cures into a solid. The fluid mixture is typically poured into forms and allowed to cure. The curing has stages as the mixture gains strength and rigidity. The forms are removed during the curing. Timing becomes important if finish work to the surfaces or patching is needed. Structural members of the forms such as cross members can prevent smoothing portions of the surface until removed and stakes leave holes when removed which require patching.

The usual material for curbs and gutters is concrete. The side view is typically that of a step in which the gutter is the lower step and the top of the curb the upper step. Typically, the vertical portion of the step is formed by placement of a faceboard on edge and positioning the faceboard with stakes in front and cross members extending between and secured to the upper edge of the faceboard and the upper edge of a backboard on the opposite side of the curb.

Timing and manpower are important. The stakes must be driven and nailed. They are placed in the gutter to be concreted. Typically a single pour is used and timely removal of the stakes is important. Too early and the face of the curb sags. Too late and removal is tougher and the filing of the holes and the finish of the surfaces more difficult. The cross members extend across the top of the curb formed and are measured and nailed to the top edges of the opposing boards. The upper edge of the boards are used to set the level of the concrete and the concrete comes up to the bottom of the cross members. To finish the surface under the cross members, the members need to be removed before the surface becomes too hard.

3. Statement of the Objects

Accordingly, it is an objective of the present invention to provide a hanger for constructing concrete curbs more economically, largely through labor savings.

Other objectives, advantages and novel features of the invention will become apparent to those skilled in the art upon examination of the invention and the accompanying drawings.

SUMMARY OF THE INVENTION

BRIEF DESCRIPTION OF THE DRAWINGS

Further objectives and advantages of the invention will be apparent from the following detailed description, taken in conjunction with the accompanying drawings illustrating a preferred embodiment of the invention. The drawings are.

DETAILED DESCRIPTION OF A PREFERRED EMBODIMENT

Figure 1:
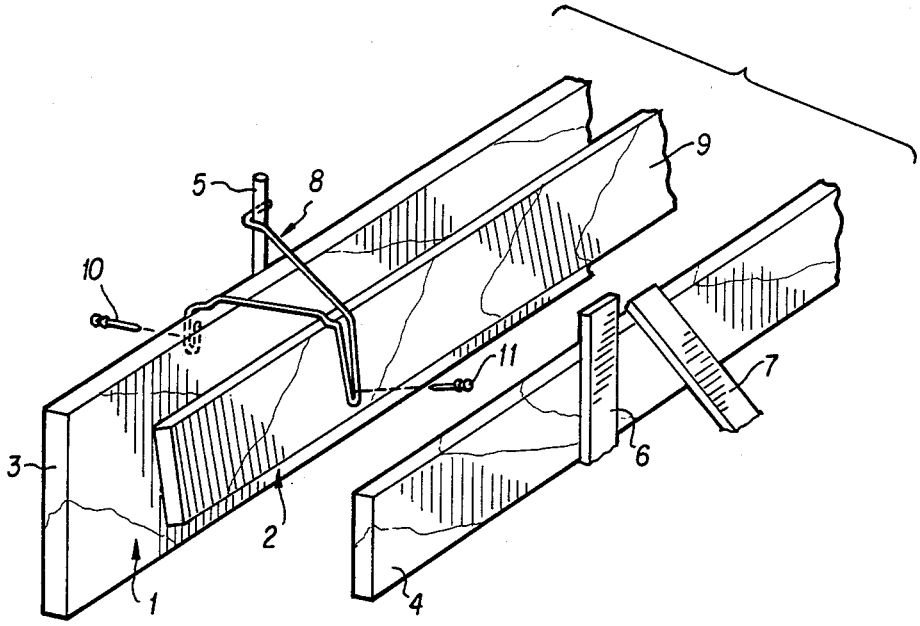
FIG. 1 is a prospective view of a curb and gutter with the forms in place the hanger invention.

In FIG. 1 the construction of a curb 1 and gutter 2 in accordance with invention is shown. A form is built on location by preparing the ground by removing earth or filling with earth to the desired ground level. A backboard 3 and toeboard 4 are positioned with backboard stake 5 and toeboard stake 6 to define a channel. These stakes can be metal or wood and are driven into the ground on the nonchannel side of the boards. For added strength a kicker 7 is used with the the backboard 3 and toeboard 4. The backboard stake 5 and toeboard stake 6 are driven vertically or at the angle desired for their respective board. The stakes are typically found at three foot intervals along the form. The kicker 7 is driven at an angle and attached by nail or otherwise near the top of the respective board to prevent movement outward when the form is filled with wet concrete.

A hanger 8 in accordance with the invention is used to position a faceboard 9 between the backboard 3 and the toeboard 4. The purpose of the hanger 8 is to position the faceboard 9 with sufficient rigidity to maintain position when the form is filled with wet concrete without the need for stakes driven within the pour area and additional crossmembers between the backboard 3 and faceboard 9.

The hanger 8 is secured in position by driving a nail 10 into the backboard 3, hooking the hanger 8 behind the backboard stake 5 and driving a nail 11 into the faceboard 6. The hanger 8 is thus attached by a means, nailing, to the backboard 3 and faceboard 6 and essentially attached by gravity to the backboard stake 5. Nailing and gravity appear the most economical means although screwing strapping or glueing at all points or to the backboard 3 and faceboard 6 are possible alternatives.

The backboard 3 and backboard stake 5 support the hanger 8 to extend in the air and the hanger 8 in turn supports the faceboard 9 in the air. Hangers 8 are placed approximately every three feet along the length of the form.

Figure 2:
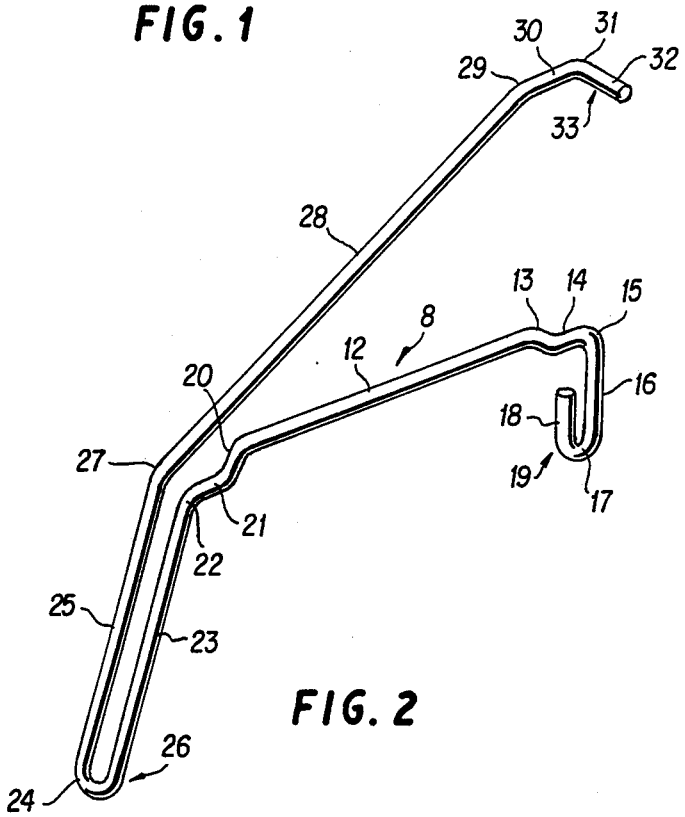
FIG. 2 is a perspective view of a hanger in accordance with the invention.

In more detail, as seen in FIG. 2, the hanger 8 has a particular configuration. The hanger 8 is formed by bending a continuous metal rod. The rod is from 30 inches to 5 feet in length depending on the size of hanger to be built and from 5/16 to $\frac{3}{8}$ inches in diameter. Variables include the distance between the backboard 3 and faceboard 9 and the height of the backboard 3 and faceboard 9.

The hanger 8 is described in terms of its spatial orientation when in use. References to horizontal and vertical are in this context.

The hanger 8 has a first horizontal length 12 which is chosen to be about 7 to 15 inches depending on the distance desired between the backboard 3 and faceboard 9. From one end of the horizontal length 12, there are two bends to form a first step 13 downward of about $\frac{3}{8}$ inch to a short second horizontal length 14. The second horizontal length 14 is about $\frac{5}{8}$ inch to 1 inch. The length is chosen to approximate the width of the top of backboard 3. In use the second horizontal length 14 is in contact with the top of the backboard 3.

Moving outward from the second horizontal length 14 there is a first 90° bend 15. The backboard 3 is normally positioned to be vertical but the first bend 15 can be changed to accomodate a slant. The angle of the first bend 15 is to have the hanger 8 extend down the backside of the backboard 3. The hanger 8 extends from the first bend 15 as a first vertical length 16 downward. Its length is about $2\frac{1}{4}$ inches for structural strength. The hanger 8 extends from the first vertical length 16 as a first U bend 17 joining the first vertical length 16 with a second vertical length 18 upward and approximately parallel to the first vertical length 16.

The first and second vertical lengths 16 and 18 need not be equal in length and the second vertical length can be much shorter. The first and second vertical lengths 16 and 18 and first U bend 17 form a first attaching means 19. For practical, simplicity, and economical purposes nailing is used with the attaching means 19.

The first U bend 17 is sufficiently tight to have the first and second vertical lengths 16 and 18 run adjacent to each other approximately 3/16 inches apart to allow a nail 11, a *6d* or *8d*, to pass between them and close to the U bend 17 and be driven into the backboard 3. In use, the nail 11 secures the hanger 8 to the backboard 3 by contact of the vertical lengths 16 and 18 with the backboard 3. A double head (duplex) nail is used to facilitate removal. The inside head contacts the vertical lengths 16 and 18 and the outside head allows the nail to be easily removed. The pairing of vertical lengths 16 and 18 helps to prevent any tendency of the faceboard 9 to rotate on a vertical axis. On the backboard 9 side the hanger 8 ends with the second vertical length 8.

The hanger 8 from the end of the first horizontal length 12 away from the first step 13 has two bends to form a second step 20 downward of about ⅜ inch to a short third horizontal length 21. The third horizontal length 21 is about ⅝ and 1 inch. The length is chosen to approximate the width of the top of faceboard 9. In use the second horizontal length 14 is in contact wtih the top of the faceboard 9.

The ⅜ inch offset of the first and second steps 13 and 20 allows the first horizontal length 12 to serve as a crossmember controlling the spacing between the backboard 3 and faceboard 9 and allows the surface of wet concrete under the first horizontal length 12 to be smoothed with troweling tools while the hanger 8 remains in position.

Moving outward from the third horizontal length 21 there is a second 90° bend 22. The faceboard 9 is normally positioned to be vertical but the curb face is sometimes set 15° from vertical by slanting the faceboard 9. This can be accomodated by having the angle of the second bend be 105°. The angle of the second bend 22 is to have the hanger 8 extend down the backside of the faceboard 9. The hanger 8 extends from the second bend 22 as a third vertical length 23 downward. The third vertical length 23 is normally longer than the first vertical length 16. The hanger 8 extends from the third vertical length 23 as a second U bend 24 joining the third vertical length 23 with a fourth vertical length 25 upward and approximately parallel to the first vertical length 23.

The length of the third and fourth vertical lengths 23 and 25 can vary from 3 to 8 inches and should be selected so that the hanger 8 extends down about ¾ of the way down the backside of the faceboard 9 to promote stability. The fourth vertical length 25 is slightly longer than the third vertical length 23.

The third and fourth vertical lengths 23 and 25 and second U bend 24 form a second attaching means 26. For practical, simplicity, and economical purposes nailing is used with the attaching means 26.

The second U bend 24 is sufficiently tight to have the third and fourth vertical lengths 23 and 25 run adjacent to each other approximately 3/16 inch apart to allow a nail 10 to pass between them and close to the U bend 24 and be driven into the faceboard 9. In use, the nail 10 secures the hanger 8 to the faceboard 9 by contact of the vertical lengths 23 and 25 with the faceboard 9. A double head (duplex) nail is used to facilitate removal.

From the fourth vertical length 25 there is a obtuse bend 27 at a point slightly above the height of the second 90° bend 22. The first obtuse bend 27 joins the fourth vertical length 25 to a first diagonal length 28. The fourth vertical length 25 is longer then the third vertical length 23 so that diagonal length 28 does not contact the top of the faceboard 9. The diagonal length spans the distance between the back sides of the faceboard 9 and backboard 3. The angle formed by the diagonal length 28 and the first horizontal length is acute and set so that diagonal length 28 intersects the plane described by front of the backboard 3 approximately 4 to 5 inches above the top of the backboard 3. At the distal end of the diagonal length 28 the hanger 8 is bent at a second obtuse bend 29. From the second obtuse bend 29 the hanger 8 extends with a fourth horizontal length 30. This fourth horizontal length 30 is approximately equal to the depth of a stake 5, round or rectangular, at which point there is a third 90° bend 31. This third 90° bend 31 is in the horizontal plane. Extending from the third 90° bend 31 is a fifth horizontal length 32 of approximately 1½ inches. A stake 5 is driven on the backside of the backboard 3 so that the fifth horizontal length 32 hooks behind the stake to form a positioning means 33 to prevent the distal end of the first horizontal length 12 from rotating downward.

I claim:

1. A hanger for use in constructing concrete curbing to eliminate stakes within the pour volume comprising of:

a. a continuous metal rod oriented to have a first horizontal length;

b. said rod extending from one end of the first horizontal length with a first step downward to a short second horizontal length thereafter to a first 90° bend to a first vertical length downward and bent thereafter to form a first attaching means;

c. said rod extending from the other end of the first horizontal length with a second step downward to a short third horizontal length thereater to a second 90° bend to a second vertical length downward and bent thereafter to form a second attaching means;

d. from the second attaching means the rod extends with a third vertical length upward to a point slightly above the third horizontal length at which point rod is bent so that the rod, extends a diagonal length across the distance spanned by the first and third horizontal length to an obtuse bend there to extend a short fourth horizontal length and then bent to form a positioning means, said positioning means consists of said forth horizontal length joined to a third 90° bend in turn joined to a fifth horizontal length.

2. The hanger of claim 1 wherein the diameter of the rod is between 5/16 and ⅜ inch.

3. The hanger of claim 1 wherein the first attaching means consists of the first vertical length extending downward to a first U bend and extending with a fourth vertical length upward and adjacent to the first vertical length.

4. The hanger of claim 1 wherein the second attaching means consists of the second vertical length extending downward to a second U bend and extending with the third vertical length upward and adjacent to the second vertical length.

5. The hanger of claim 1 wherein the height of the first horizontal length is about ⅜ inch above that of the second horizontal length and that of the third horizontal length.

* * * * *